US006939126B2

(12) United States Patent
Boyes

(10) Patent No.: US 6,939,126 B2
(45) Date of Patent: Sep. 6, 2005

(54) GAS BURNER

(75) Inventor: Michael Boyes, Derby (GB)

(73) Assignee: Aeromatix Limited, East Yorkshire (GB)

( * ) Notice: Subject to any disclaimer, the term of this patent is extended or adjusted under 35 U.S.C. 154(b) by 154 days.

(21) Appl. No.: 10/391,493

(22) Filed: Mar. 17, 2003

(65) Prior Publication Data

US 2004/0121274 A1 Jun. 24, 2004

(30) Foreign Application Priority Data

Dec. 21, 2002 (GB) ..... 0229988

(51) Int. Cl.[7] ..... F23D 3/40

(52) U.S. Cl. ..... 431/7; 431/351; 431/331; 126/91 R

(58) Field of Search ..... 431/7, 326, 329, 431/351, 265, 350, 352, 328, 331, 354; 126/85 R, 92 R, 92 AC, 91 R

(56) References Cited

U.S. PATENT DOCUMENTS 915,239 A * 3/1909 Stapp ..... 126/59.5
1,219,906 A * 3/1917 Barschow ..... 431/356
1,333,577 A * 3/1920 Ruppel ..... 431/195
6,139,312 A * 10/2000 Lasagni ..... 431/354
6,532,950 B2 * 3/2003 Meurer ..... 126/29

FOREIGN PATENT DOCUMENTS

| | | |
|---|---|---|
| DE | 295 10 374 | 10/1995 |
| EP | 0 879 993 | 11/1998 |
| FR | 2 676 269 | 11/1992 |
| JP | 61276613 | 12/1986 |
| JP | 63213713 | 9/1988 |
| JP | 11141812 | 5/1999 |

* cited by examiner

*Primary Examiner*—Stephen Gravini
(74) *Attorney, Agent, or Firm*—Smith-Hill and Bedell

(57) ABSTRACT

A gas burner (10) includes an internal cavity (20) for receiving a gas and air mixture and an external substantially cylindrical wall (16) surrounding the cavity (20). The wall (16) is provided with through holes (32) for allowing gases to pass from the cavity (20) to an exterior burner (10) for combustion. The wall (16) is made up of one or more wall elements (30) in the form of sheets of material shaped so that together they form a substantially cylindrical shape. The wall includes at least one join between adjacent edge portions (34*a*, 34*b*) of the wall elements, the join being welded and at least the part of one edge portion (34*a*) overlying at least a part of the other edge portion (34*b*) in the region of the join.

13 Claims, 6 Drawing Sheets

SECTION A-A

GAS BURNER

The invention relates to a gas burner and particularly but not exclusively to a gas burner for use in domestic heating appliances. The burner may be of the "premix" type, meaning that all the air required for complete combustion is mixed with the fuel gas prior to burning.

Conventional premix burners include a cavity for receiving a gas and air mixture and an outer cylindrical wall surrounding the cavity and containing through holes in the form of flame ports through which the gas and air mixture may pass for combustion.

The outer wall is conventionally made by bending a piece of sheet material into a cylindrical shape and welding adjacent edges together to form an axial join.

According to the invention there is provided a gas burner including:

an internal cavity for receiving a gas and air mixture;

an external substantially cylindrical wall surrounding the cavity, the wall being provided with through holes for allowing gases to pass from the cavity to an exterior of the burner for combustion;

wherein the wall is made of one or more wall elements in the form of sheets of material shaped so that together they form a substantially cylindrical shape, the wall including at least one join between adjacent edge portions of the wall element or wall elements, the join being non-welded and at least a part of one edge portion overlying at least a part of the other edge portion in the region of the join.

Preferably the wall comprises two substantially semi-cylindrical wall elements, the join being formed between an edge portion of one wall element and an adjacent edge portion of the other wall element. In this case, a similar join will be formed between the respective other edge portions of the two wall elements.

Alternatively, the wall may comprise a single substantially cylindrical wall element, the join being formed between the two opposite edge portions of the cylindrical wall element.

Preferably at least one edge portion of the wall element includes a plurality of tabs extending generally in the tangential direction of the substantially cylindrical wall. Preferably the tabs constitute part of the edge portion which overlies at least a part of the other edge portion. Preferably the tabs are radially offset relative to a main body of the wall element such that they are positioned inwardly or outwardly relative to the main body. Preferably the tabs are offset such that they are positioned inwardly of the main body of the wall element.

Preferably the tabs are offset by an amount substantially equal to the thickness of the wall such that they lie adjacent to the main body at the other edge portion.

Preferably the tabs are spaced apart in the axial direction of the wall element. Preferably the axial length of the gaps between the tabs is substantially equal to the axial length of the tabs.

Preferably both edge portions include a plurality of tabs, tangentially, the tabs of one edge portion being axially aligned with the gaps between tabs of the other edge portion.

Preferably the tabs include orifices extending therethrough. The orifices are preferably larger than the holes in the substantially cylindrical wall. The frequency and spacing of the orifices may be substantially equivalent to the frequency and spacing of the through holes. Preferably the orifices in the tabs at one edge portion are substantially concentric with the through holes in the main body at the other edge portion.

Preferably the tabs have no sharp corners and may be substantially cylindrical in shape.

The through holes are preferably between 0.5 mm and 3 mm in diameter. The through holes may be arranged in axial rows, holes in adjacent axial rows being offset from one another. Preferably the through holes are spaced between 2 mm and 5 mm apart.

The wall may be between 50 mm and 500 mm in axial length and may be between 50 mm and 200 mm in diameter. The wall thickness may be between 0.5 mm and 2 mm.

The burner preferably further includes an internal baffle which is substantially concentric with the external substantially cylindrical wall. The baffle preferably includes perforations extending therethrough.

The burner preferably further includes an end cap closing one axial end of the burner. The burner may further include a mounting flange located at an opposite axial end of the burner, the mounting flange being attached to and extending radially outwardly from the wall.

The material of the substantially cylindrical wall may be a heat resistant steel, preferably a stainless steel.

According to the invention there is further provided a method of manufacturing a gas burner including an internal cavity for receiving a gas and air mixture and an external substantially cylindrical wall surrounding the cavity, the method including the steps of providing one or more wall elements in the form of sheets of material shaped so that together they form a substantially cylindrical shape, and creating a join between adjacent edge portions of the wall elements, the join being non-welded and at least a part of one edge portion overlying at least a part of the other edge portion in the region of the join.

The wall may be formed from two substantially semi-cylindrical wall elements, the join being created between an edge portion of one wall element and an edge portion of the other wall element. In this case, a similar join is created between the other edge portions of the respective wall elements. Alternatively the wall may comprise a single substantially cylindrical wall element, the join being created between the two opposite edge portions of the cylindrical wall element.

Preferably the method includes the step of forming a plurality of tabs at at least one edge portion, the tabs extending generally in the tangential direction of the substantially cylindrical wall. Preferably the tabs constitute part of the edge portion which overlies the other edge portion. Preferably the tabs are formed such that they are offset in the radial direction relative to a main body of the wall element, such that they are positioned radially inwardly or outwardly relative to the main body. Preferably the tabs are positioned radially inwardly relative to the main body of the wall element.

Preferably the tabs are formed such that they are offset by an amount substantially equal to the thickness of the wall, such that they lie adjacent to the main body at the other edge portion.

Preferably the tabs are formed such that they are spaced apart in the axial direction of the wall element. Preferably they are formed such that the axial lengths of the gaps between the tabs are substantially equal to axial length of the tabs.

Preferably both edge portions are formed to include a plurality of tabs, the tabs of one edge portion being axially aligned with the gaps between the tabs of the other edge portion.

Preferably the method includes the step of forming orifices extending through the tabs. The orifices may be formed such that they are larger than the through holes in the cylinder. The frequency and spacing of the orifices may be substantially equivalent to the frequency and spacing of the through holes. Preferably the orifices in the tabs at one edge portion are substantially concentric with the through holes in the main body at the other edge portion.

An embodiment of the invention will be described for the purpose of illustration only with reference to the accompanying drawings, in which.

Figure 1:
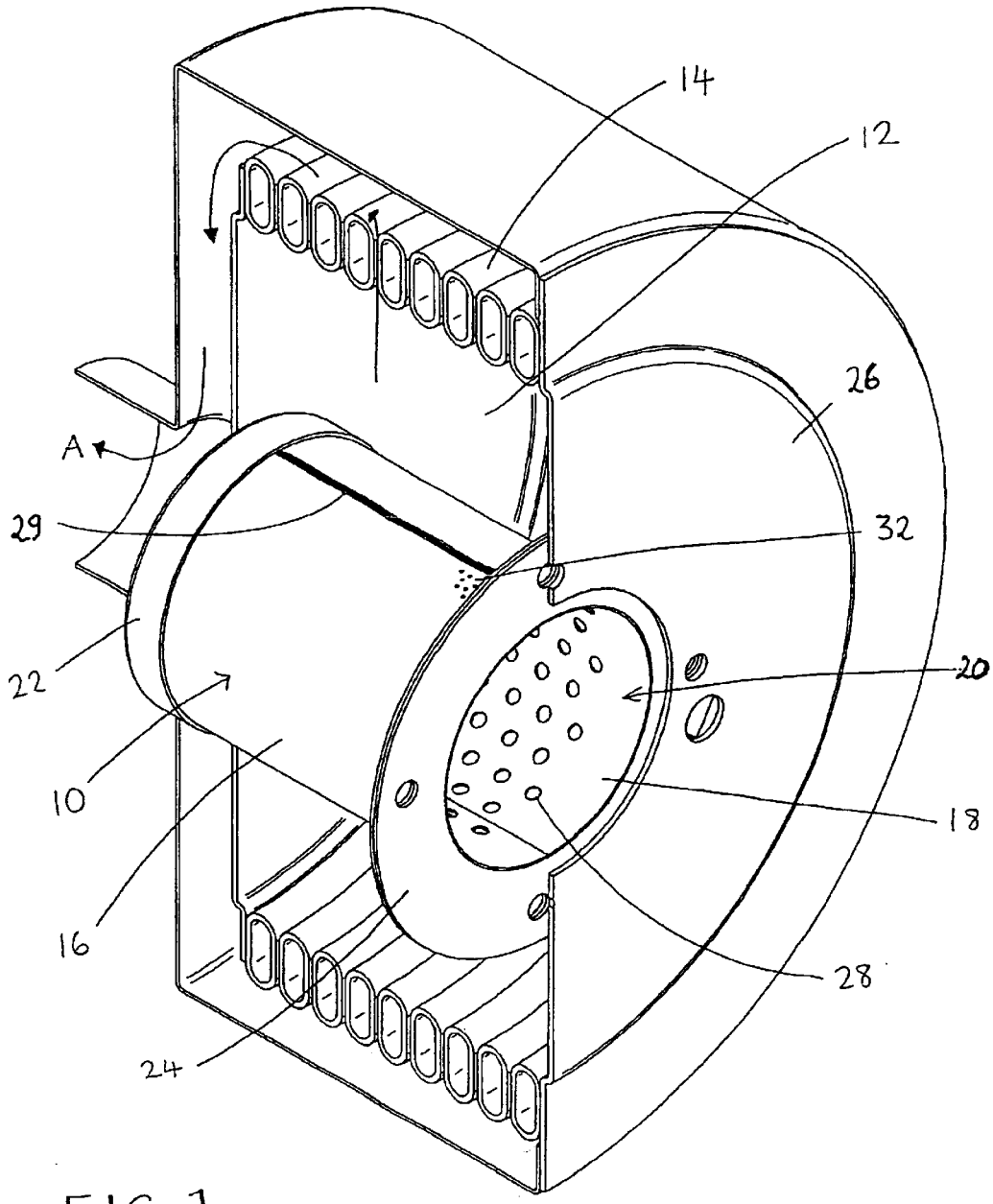
FIG. 1 is a diagrammatic perspective view of a conventional burner in place within an appliance.
Figure 3:
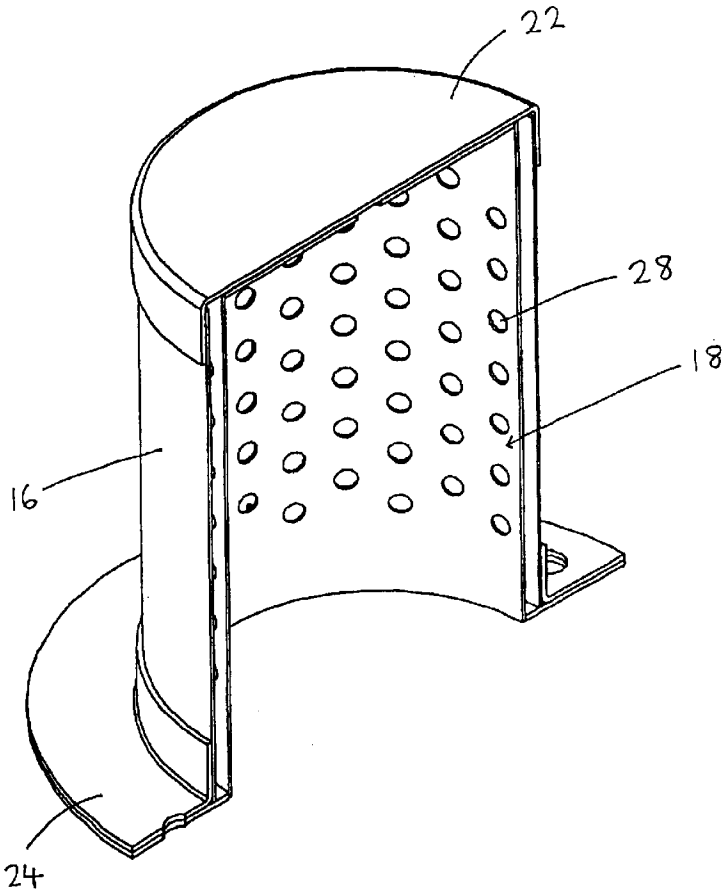
FIG. 3 is a cut-away view of the burner of FIG. 2.
Figure 2:
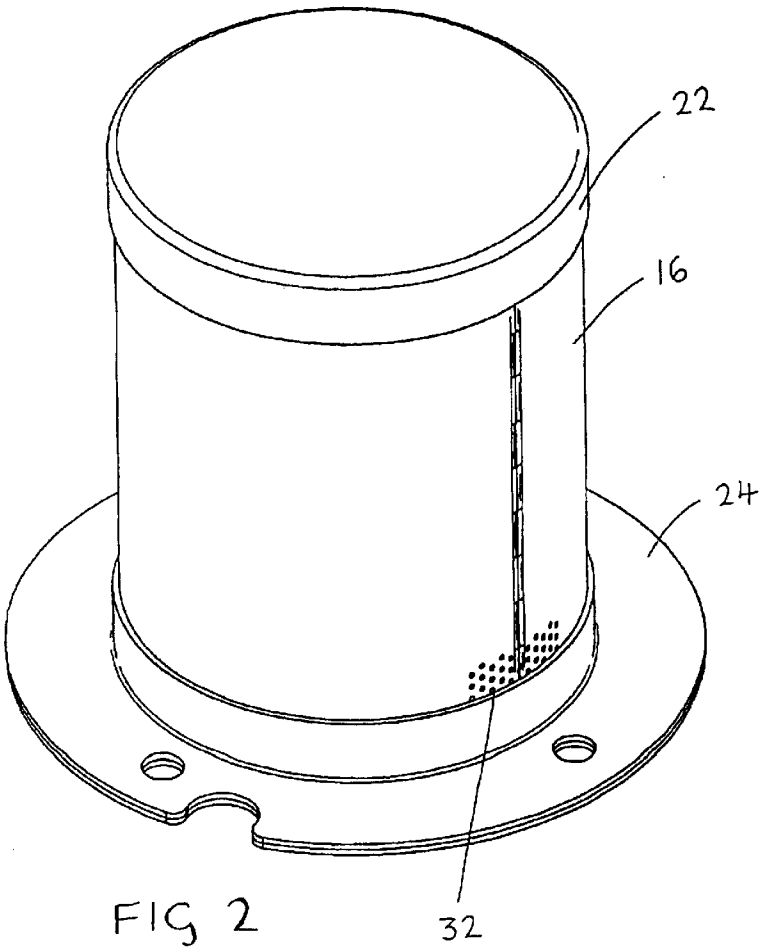
FIG. 2 is a diagrammatic perspective view of a burner according to the invention.
Figure 5:
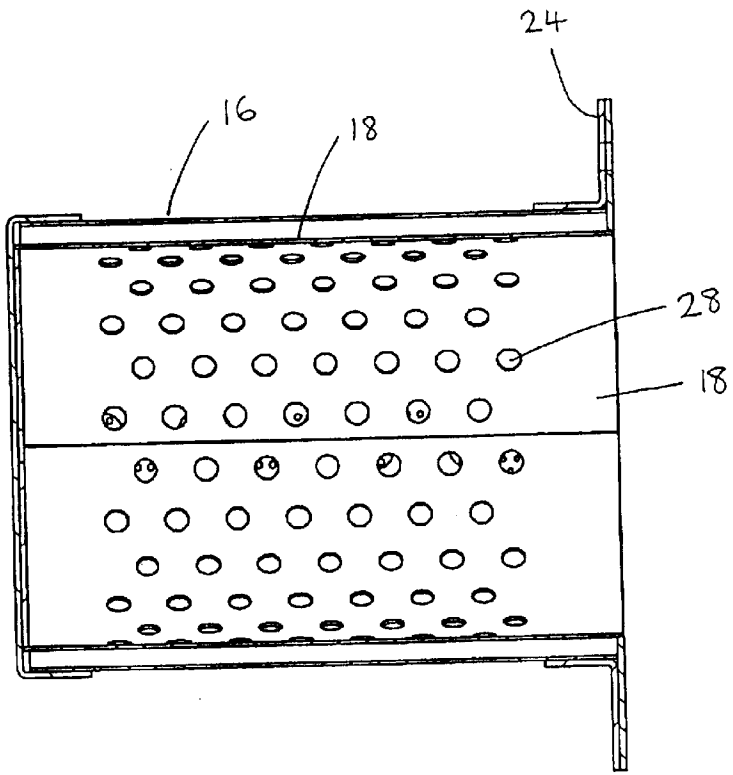
FIG. 5 is a section on the line A—A in FIG. 4.
Figure 4:
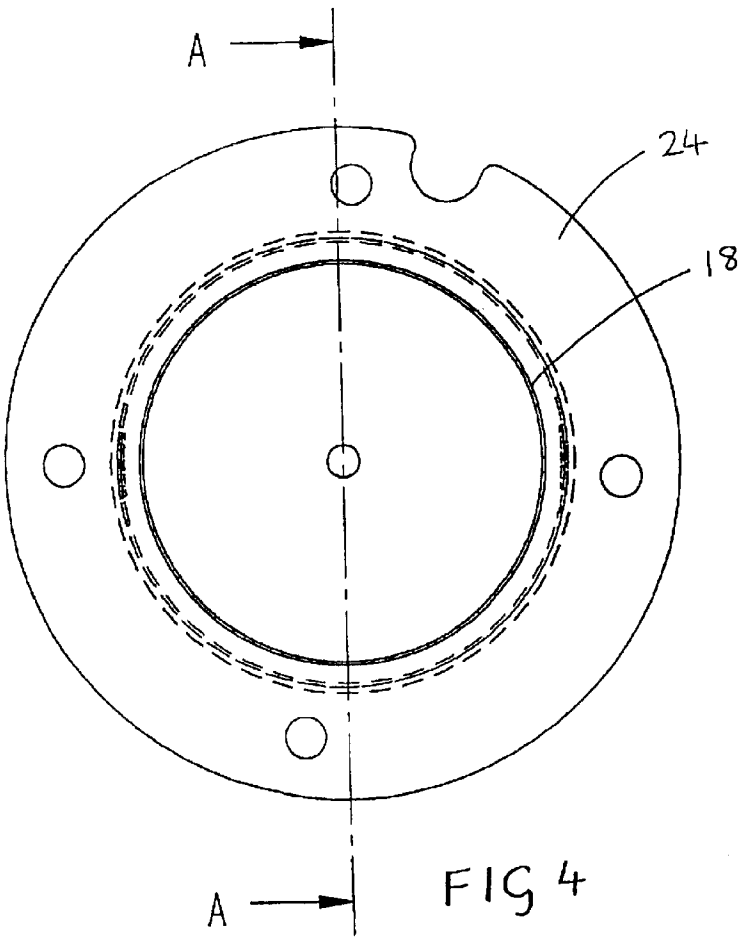
FIG. 4 is an axial end view of the burner of FIG. 2, viewed from the inlet end.

Referring to FIG. 1, a gas burner 10 is located within a heating appliance including a combustion zone 12 and the heat exchanger 14.

The gas burner 10 includes an outer cylindrical wall 16 and a concentric inner baffle 18, enclosing an internal cavity 20. An end cap 22 is attached to the outer cylindrical wall 16, and closes one axial end of the gas burner 10. A mounting flange 24 is attached to the other axial end of the wall 16 and extends radially outwardly therefrom. The gas burner 10 is attached to a housing 26 via a mounting flange 24.

The outer cylindrical wall 16 is provided with through holes in the form of flame ports 32, just a few of which are illustrated in FIG. 1. The flame ports 32 are about 1 mm in diameter and their centres are about 2 to 3 mm apart. The flame ports 32 are arranged evenly over the whole of the cylindrical wall 16.

The inner baffle 18 is provided with larger through holes 28.

In use, a gas and air mixture is passed into the cavity 20 and passes through the holes 28 in the baffle 18, through the flame ports 32 in the outer cylindrical wall 16 and into the combustion zone 12 where burning takes place. The heat thereby produced is utilised via the heat exchanger 14, with the flue products passing out of the unit as indicated by the arrow A.

Conventionally the outer cylindrical wall 16 of the burner is formed from the piece of sheet metal bent to form a cylinder and welded along a seam 29.

FIGS. 2 to 5 illustrate a burner 10 according to the invention. The cylindrical wall 16 of the burner 10 is illustrated in FIGS. 6, 7 and 8.

The overall construction of the gas burner 10 according to the invention is similar to that described with reference to the prior art. The burner 10 includes an outer cylindrical wall 16 and a concentric baffle 18, an end cap 22 and a mounting flange 24. However, the construction of the outer cylindrical wall 16 is quite different from the prior art.

Figure 6:
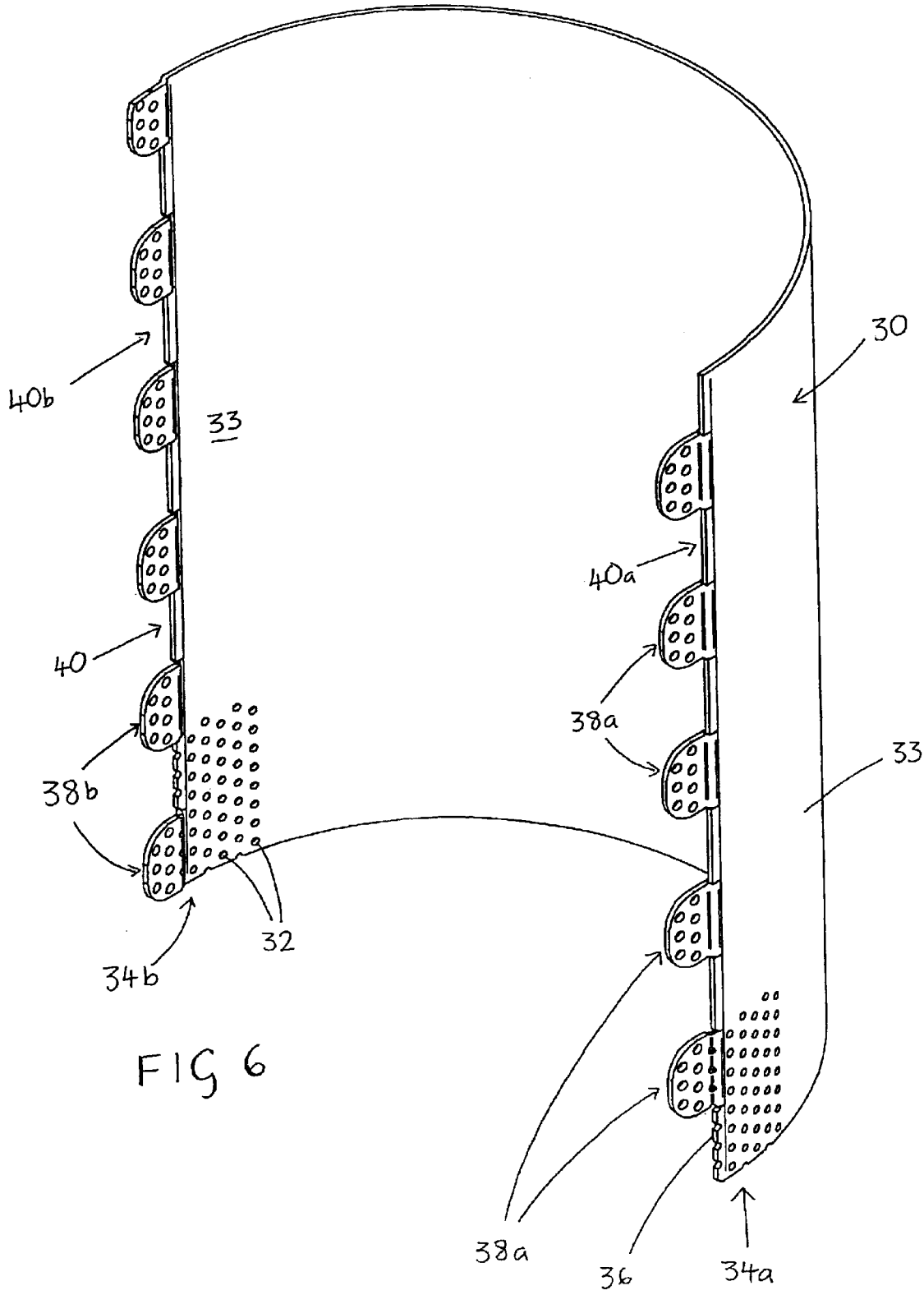
FIG. 6 is a diagrammatic perspective view of a wall element for a burner according to the invention.
Figure 7:
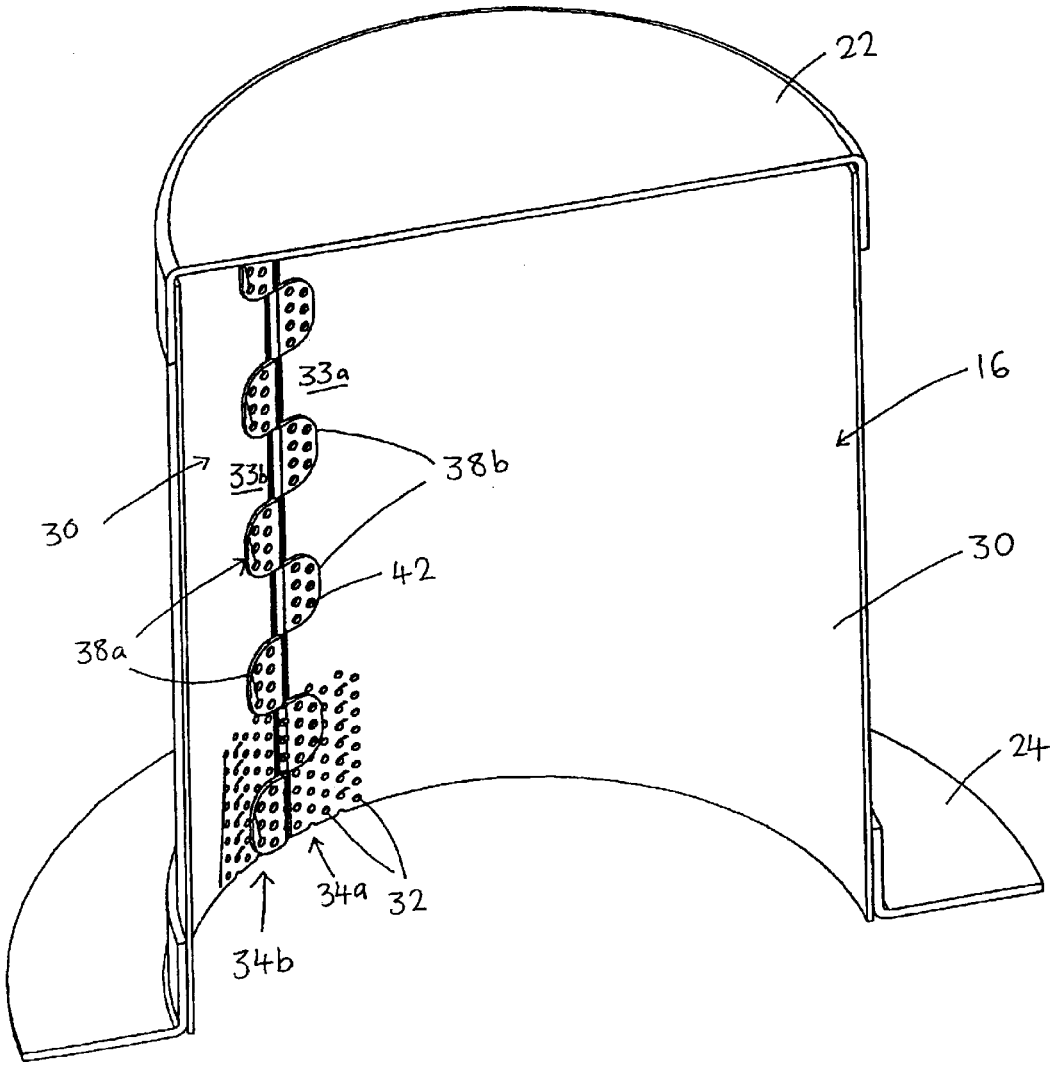
FIG. 7 is a diagrammatic perspective view of a cylindrical outer wall of the burner according to the invention as viewed from inside and sectioned to show the application of the invention.
Figure 8:
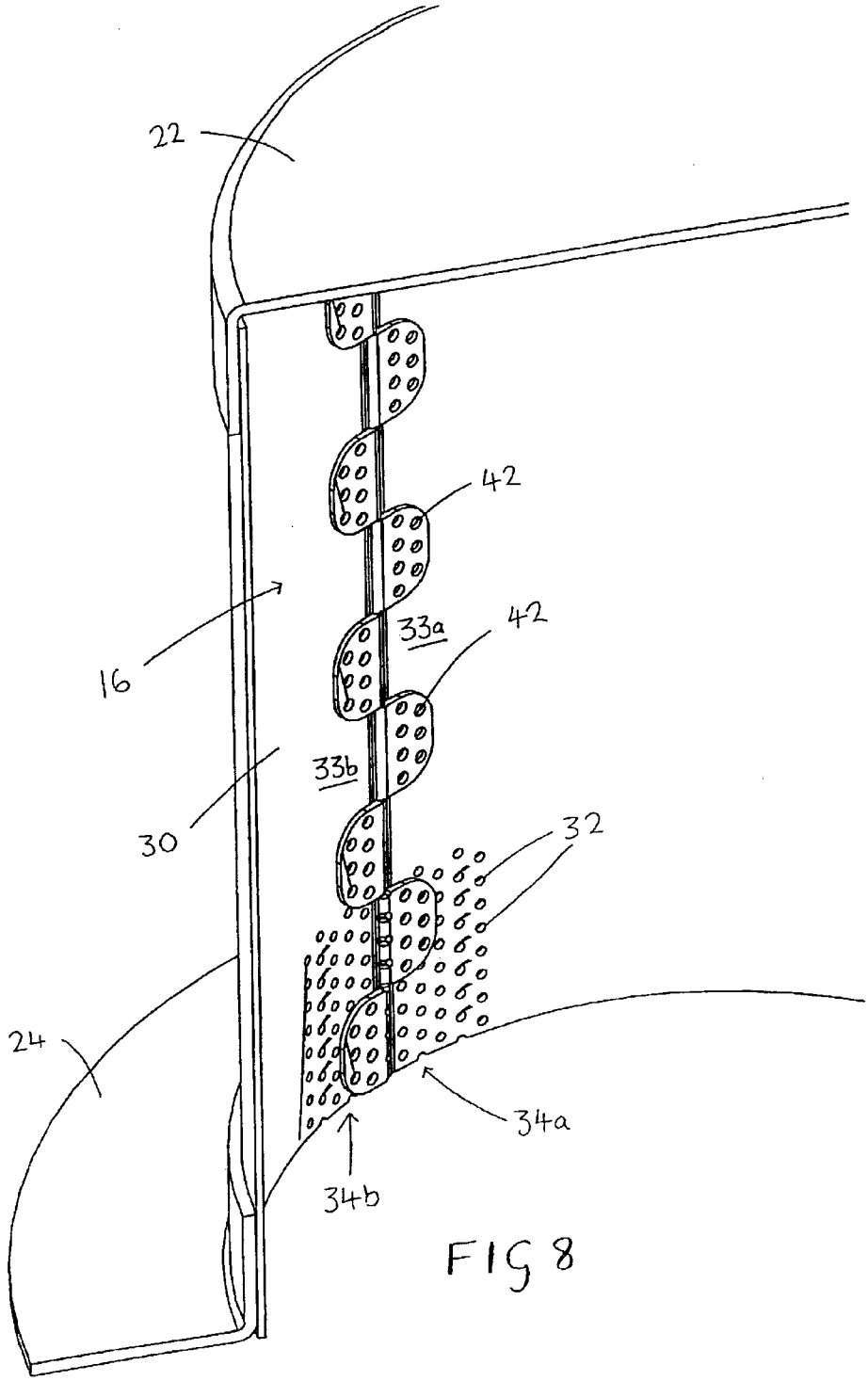
FIG. 8 is an enlarged view of FIG. 7.

Referring to FIGS. 6 to 8, the outer cylindrical wall 16 comprises two substantially semi-cylindrical wall elements 30. Each wall element is provided with a plurality of flame ports 32. A limited number of these ports are illustrated in the drawings but in reality the flame ports 32 extend over the whole area of the wall element 30. The flame ports 32 are arranged in axially oriented rows, with ports in adjacent rows being axially offset. The ports are around 1 mm in diameter and are spaced with their centres about 2 to 3 mm apart.

Each wall element 30 includes a semi-cylindrical main body 33 and a plurality of tabs 38 extending generally tangentially from the main body, in each of two opposite edge regions 34*a*, 34*b* of the wall element. The tabs extend from axially oriented edges 36 which define the edges of the main body 33. The material of the wall elements 30 is shaped in the region where each tab 38 joins the main body 33, at the edge 36, such that the tab 38 is radially offset relative to the main body 33. In the illustrated embodiment, the tabs 38 are offset such that they are located radially inwardly of the main body 33 of the wall element 30.

FIG. 6 illustrates one wall element but the other substantially semi-cylindrical wall element 30 would be identical.

The tabs 38 are spaced apart in the axial direction such that gaps 40 are provided therebetween. The axial extent of the gaps is substantially the same as the axial extent of the tabs 38.

In one edge region 34*a* of the wall element 30, tabs 38*a* are axially offset from tabs 38*b* located in the opposite edge region 34*b*. The tabs are precisely out of phase with one another such that gaps 40*a* in the edge region 34*a* are axially aligned with the tabs 38*b* in the opposite edge region 34*b*.

Referring to FIGS. 7 and 8, two wall elements 30 may be joined together by arranging the adjacent edge regions 34*a*, 34*b* of the two wall elements such that the tabs 38*a* at the edge region 34*a* of one wall element overlie the main body 33*b* in the adjacent edge region 34*b* of the other wall element. The two wall elements 30 thus form a cylinder including two joins. The interlocking tabs 38*a*, 38*b* hold the two wall elements 30 together without any need for a weld.

The tabs 38 include flame ports 42 extending therethrough. When the wall elements are in engagement with one another as illustrated in FIGS. 7 and 8, the flame ports 42 in each tab substantially overlie the flame ports 32 in the adjacent wall element.

There is thus provided an improved gas burner in which the cylindrical outer wall is cheaper and more straightforward to manufacture than in prior art welded designs. In addition, the welding of the cylinder has proved to be the main weakness in existing products, with failure in service usually being attributed to the failure of the welded joint. In addition, overheating of the flame port cylinder usually occurs in the unperforated areas adjacent to the welded joint. The design according to the invention allows for the provision of an uninterrupted flame port pattern eliminating the blank areas and reducing overheating.

The design according to the invention also allows for the use of high temperature resistant metal alloys which are unsuitable for welding.

Production of the cylinder in two identical halves reduces the cost and complexity of the piercing and forming equipment. However production in this manner if the joints were welded would double the welding cost, the unperforated areas and the vulnerability of the joints.

Various modifications may be made to the above described embodiment without departing from the scope of the invention. In particular, the arrangement of the flame ports may be modified, the sizes and shapes of the tabs may be altered and the materials may be changed.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A gas burner including:

an internal cavity for receiving a gas and air mixture; and an external substantially cylindrical wall surrounding the cavity, the wall being provided with through hales for allowing gases to pass from the cavity to an exterior of the burner for combustion;

wherein the wall is made of one or more wall elements in the form of sheets of material shaped so that together the sheets of material form a substantially cylindrical shape, the wall including at least one join between adjacent edge portions of the wall element or wall elements, the join being non-welded, and wherein both of the adjacent edge portions include a plurality of tabs extending generally in the tangential direction of the substantially cylindrical wall, the tabs are spaced apart in the axial direction of the wall elements to define gaps between the tabs, the tabs of one edge portion being axially aligned with gaps defined between the tabs of the other edge portion and the tabs of edge portion overlying at least a part of the other edge portion in the region of the join.

2. A gas burner according to claim 1, wherein the wall comprises two substantially semi-cylindrical wall elements, the join being formed between an edge portion of one wall element and an adjacent edge portion of the other wall element.

3. A gas burner according to claim 1, wherein the tabs are radially offset relative to a main body of the wall element such that they are positioned inwardly or outwardly relative to the main body.

4. A gas burner according to claim 3, wherein the tabs are offset by an amount substantially equal to the thickness of the wall such that they lie adjacent to the main body at the other edge portion, the axial length of the gaps between the tabs being substantially equal to the axial length of the tabs.

5. A gas burner according to claim 4, wherein the tabs include orifices extending therethrough, the orifices being larger than the holes in the substantially cylindrical wall, and the frequency and spacing of the orifices being substantially equivalent to the frequency and spacing of the through holes.

6. A gas burner according to claim 5, wherein the orifices in the tabs at one edge portion are substantially concentric with the through holes in the main body at the other edge portion.

7. A gas burner according to claim 6, wherein the tabs have no sharp corners.

8. A gas burner according to claim 1, wherein the through holes are arranged in axial rows, holes in adjacent axial rows being offset from one another.

9. A gas burner according to claim 1, wherein the material of the substantially cylindrical wall is a heat resistant steel.

10. A method of manufacturing a gas burner including an internal cavity for receiving a gas and air mixture and an external substantially cylindrical wall surrounding the cavity, the method including the steps of providing one or more wall elements in the form of sheets of material shaped so that together the sheets of material form a substantially cylindrical shape, and creating a join between adjacent edge portions of the wall element or wall elements, the join being non-welded, wherein both edge portions are formed to include a plurality of tabs extending generally in the tangential direction of the substantially cylindrical wall, the tabs are spaced apart in the axial direction of the wall elements to define gaps between the tabs, the tabs of one edge portion being axially aligned with gaps defined between the tabs of the other edge portion and the tabs of each edge portion overlying at least a part of the other edge portion in the region of the join.

11. A method according to claim 10, wherein the wall is formed with two substantially semi-cylindrical wall elements, the join being created between an edge portion of one wall element and an edge portion of the other wall element.

12. A method according to claim 10, wherein tabs are formed such that they are offset in the radial direction relative to a main body of the wall elements, such that they are positioned radially inwardly or outwardly relative to the main body.

13. A method according to claim 12, wherein the tabs are formed such that they are offset by an amount substantially equal to the thickness of the wall, such that they lie adjacent to the main body at the other edge portion, the axial lengths of the gaps between the tabs being substantially equal to the axial length of the tabs.

* * * * *